United States Patent [19]

Siden

[11] 4,208,788

[45] Jun. 24, 1980

[54] SPLICING ELECTRICAL WIRES

[75] Inventor: Dennis C. Siden, Portola Valley, Calif.

[73] Assignee: Raychem Corporation, Menlo Park, Calif.

[21] Appl. No.: 4,401

[22] Filed: Jan. 18, 1979

Related U.S. Application Data

[62] Division of Ser. No. 653,008, Jan. 28, 1976.

[51] Int. Cl.[2] ..... H01R 43/04

[52] U.S. Cl. ..... 29/862; 174/84 C; 29/871

[58] Field of Search ..... 174/74 A, 84 R, 84 C, 174/90, 138 F, DIG. 8; 29/628, 630 F; 339/201, 213 R, 213 T, 221 R, 276 R, 276 T, DIG. 1

[56] References Cited

U.S. PATENT DOCUMENTS

| | | | |
|---|---|---|---|
| 2,429,585 | 10/1947 | Rogoff | 174/84 C |
| 2,930,836 | 3/1960 | Floyd, Jr. | 174/84 C |
| 3,143,595 | 8/1964 | Martin | 174/84 C |
| 3,212,207 | 10/1965 | Searing | 174/112 X |
| 3,243,211 | 3/1966 | Wetmore | 174/DIG. 8 X |
| 3,708,611 | 1/1973 | Dinger | 174/84 C |

*Primary Examiner*—Laramie E. Askin
*Attorney, Agent, or Firm*—Lyon & Lyon

[57] ABSTRACT

A method for splicing electrical wires uses a crimp barrel removably disposed in an insulating sleeve. A first wire is inserted into the barrel, and then the barrel is removed from the sleeve without damaging the sleeve. A second wire is inserted into the barrel and the barrel is crimped to retain the wires. Then the crimp barrel is placed into the sleeve.

10 Claims, 5 Drawing Figures

SPLICING ELECTRICAL WIRES

This is a division of application Ser. No. 653,008, filed Jan. 28, 1976.

BACKGROUND OF THE INVENTION

The present invention relates to an improved method of splicing electrical wires and, in particular, relates to an improved method comprising use of an improved insulating sleeve having a crimp barrel removably retained therein.

In the past, insulated crimp splicers have been comprised of two separate pieces, a ductile metal barrel and a heat-shrinkable insulating sleeve having a bore running therethrough capable of receiving the metal barrel. A splice between two electrical wires was formed by first sliding the sleeve onto one of the wires. The ends of both wires were then stripped and inserted into opposite ends of the metal barrel. The barrel was then compressibly deformed into crimping engagement with the corresponding wires by the application of crimping pressures. The sleeve was slid down the wire and over the barrel. The sleeve was then shrunk down onto the barrel to protect the splice from the environment. Unfortunately, in some cases, because the barrel and the sleeve were separate pieces, one would become lost during storage. Further, in some cases, while forming the splice, the sleeve was inadvertently not put onto one of the wires before crimping the wires into the barrel. In these cases, it was necessary to cut the wires from the barrel and begin again with a new barrel.

Other crimp splicers have been comprised of an insulating sleeve having a metal barrel permanently positioned therein. One prior method of manufacturing this type of crimp splicer involved insertion of the barrel into a heat-shrinkable sleeve in its expanded state and then partially shrinking the sleeve down onto the barrel to permanently retain the barrel therein. Another method of manufacturing this type of crimp splicer involved forceful insertion of a barrel into the bore of the sleeve having a slightly smaller diameter than the diameter of the barrel. A splice between two electrical wires was then formed by stripping the ends of the wires and inserting them into opposite ends of the metal barrel. The barrel was then compressibly deformed into crimping engagement with the corresponding wires by the application of crimping pressures to the sleeve overlying the barrel. The crimping pressures were transmitted directly through the sleeve to the barrel thereby deforming the barrel and permanently retaining the conductors therein. Unfortunately, in response to the crimping pressure, that portion of the wall of the sleeve in the crimped areas was permanently damaged to the extent that residual wall thickness was reduced. In some cases, the damage to the wall caused the tube to split during subsequent heat shrinkage and sealing operations, thereby exposing the underlying conductors. In other cases, the wall thickness was reduced to a point where it was insufficient to provide the necessary physical and dielectric strength.

One prior solution to the problem of damage to the wall caused by crimping involved the reduction of the strength of the crimping forces. Although the reduced crimping forces did not cause damage to the wall of the sleeve, unfortunately, the resultant crimp was, in many cases, unacceptable due to the lower quality of the crimp and crimp connection. Another prior solution to the problem involved shaping the crimping dies so that they would distribute the crimping forces evenly throughout the wall of the tube. Unfortunately, again, the resultant crimp was, in many cases, unacceptable.

Another prior solution to the problem of damage to the wall was disclosed in Martin U.S. Pat. 3,143,595, and involved forming the metal barrel in a substantially hour-glass configuration. The hour glass configuration permitted a cold plastic flow or spread of the sleeve in response to the crimping forces thereby aiding in the prevention of damage to the wall of the sleeve. However, the crimp operation still resulted in some damage to the wall of the sleeve.

SUMMARY OF THE INVENTION

It is therefore an object of the present invention to provide an improved method for splicing electrical wire which enables the formation of a quality crimp in the barrel without causing damage to the sleeve.

This and other objects and advantages are obtained by using a crimp splicer comprising a generally cylindrically-shaped insulating sleeve provided with a bore having a crimp barrel removably retained therein. The sleeve is preferably adapted to enable frictional and/or mechanical retention of the barrel within the sleeve. To form the splice, the barrel is removed from the sleeve preferably by insertion of electrical wire which has been stripped into the sleeve. Upon removal from the sleeve, the barrel is crimped onto the wire. The other wire is then stripped and inserted into the other end of the barrel and crimped into place. The barrel is then reinserted into the sleeve. In its preferred embodiment, the sleeve consists essentially of a heat-shrinkable material.

BRIEF DESCRIPTION OF THE DRAWINGS

A more thorough disclosure of the objects and advantages of the present invention is presented in the detailed description which follows and from the accompanying drawings in which.

DETAILED DESCRIPTION OF THE INVENTION

Figure 1:
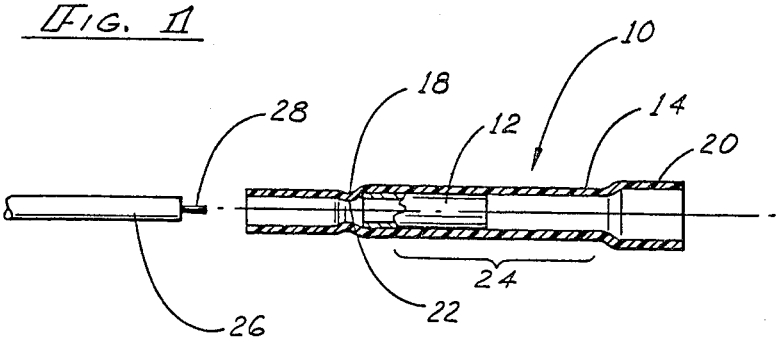
FIG. 1 is a cross-sectional view of the crimp splicer with the barrel positioned in the sleeve.

The present invention contemplates the formation of an insulated electrical crimp using a splicer comprising an insulating sleeve having a crimp barrel removably retained therein. Referring to FIG. 1, there is shown the improved crimp splicer 10 comprising generally the crimping barrel 12 and the insulating sleeve 14.

Describing the elements of the splicer in more detail, the crimp barrel 12 is preferably cylindrically-shaped and consists of a ductile metal which is a good conductor and is capable of being deformed with a crimping device. Suitable metals are copper, aluminum and brass. The barrel is also preferably provided with a centrally located conductor stop 16 shown in FIG. 2 formed by perforating one side of the wall of the barrel and forcing a portion of the wall into the interior of the barrel.

The insulating sleeve 14 is preferably generally cylindrically-shaped and has a bore formed therein which runs the length of the sleeve. The sleeve is shaped and sized to enable frictional retention of the barrel disposed within the bore of the sleeve. Frictional retention generally requires that some part of the outer insulating sleeve must always be in contact with some part of the crimp barrel being held in position and requires that reasonably close tolerances be held during the fabrication process so that the retention forces are within appropriate limits. The sleeve is further shaped and sized to enable removal of the barrel from the sleeve for crimping without damaging the sleeve and subsequent reinsertion of the barrel into the sleeve.

Figure 2:
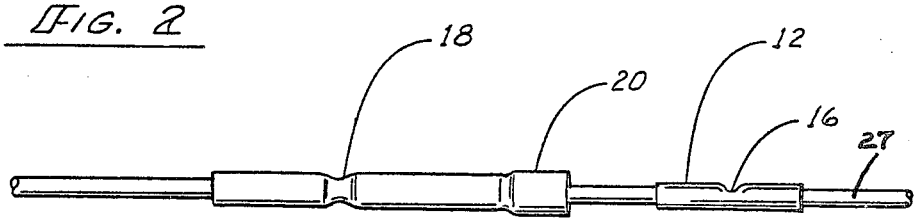
FIG. 2 is an exploded perspective view of the crimp splicer with an electrical wire inserted therethrough.

Referring to FIGS. 1 and 2, there is shown a sleeve formed according to the present invention. The sleeve 14 is generally cylindrically-shaped and is provided with circumferentially disposed channel 18 and flare 20 formed in its wall. Channel 18 forms a corresponding rim 22 protruding into the interior of sleeve 14. The rim 22 has a diameter less than the outer diameter of barrel 12 and functions to center the barrel midway along the length of the sleeve. The inner diameter of the central portion 24 of the sleeve is approximately equal to the outer diameter of the barrel 12 thereby enabling frictional retention of the barrel within the sleeve. To form a splice, electrical wire 26 is stripped to expose conductor 28. Wire 26 is then inserted into the end of the sleeve 14 past rim 22 and into barrel 12. Referring to FIG. 2, the barrel is then urged from sleeve 14 by pushing on wire 26. After the barrel 12 has been removed from the, sleeve it is crimped by any manner well known in the art to permanently retain wire 26 therein. Then wire 27 is stripped, inserted into the other end of barrel 12 and crimped to permanently retain it therein. The barrel is then reinserted into sleeve 14 by holding the sleeve stationary and pulling on wire 26. Flare 20 has a larger diameter than barrel 12 to facilitate the insertion of the barrel into the sleeve by enabling alignment of the barrel with the bore of the central portion 24 of the sleeve.

Figure 3:
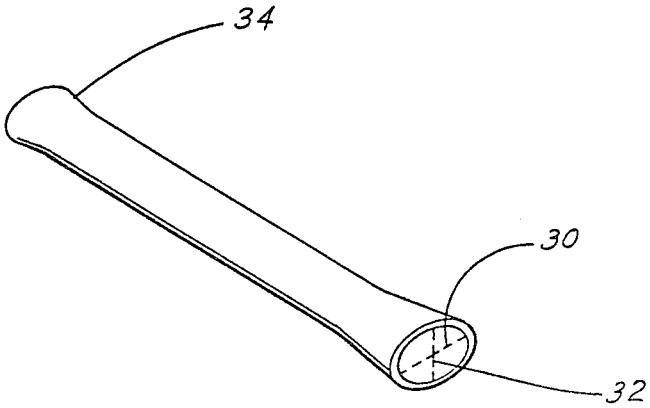
FIG. 3 is an alternate embodiment of the crimp splicer.

In FIG. 3, there is shown an alternative embodiment having a sleeve formed with a bore having a shape other than round. The sleeve shown has an oval shaped bore for at least a portion of its length wherein the major diameter 30 of the bore is larger than the diameter of the barrel and the minor diameter 32 of the bore is smaller than the diameter of the barrel. The barrel may be inserted or removed from the sleeve by applying pressure along the major diameter of the sleeve thereby deforming the bore of the sleeve to round. In its deformed state, the diameter of the bore is larger than the diameter of the barrel. The barrel may then be easily inserted or removed from the sleeve. When the pressure is released, the bore of the sleeve will regain its original shape and frictionally retain the barrel therein along its minor axis. The ends 34 of the sleeve are preferably slightly flared outwardly to facilitate insertion of the barrel and the wires into the sleeve.

Figure 4:
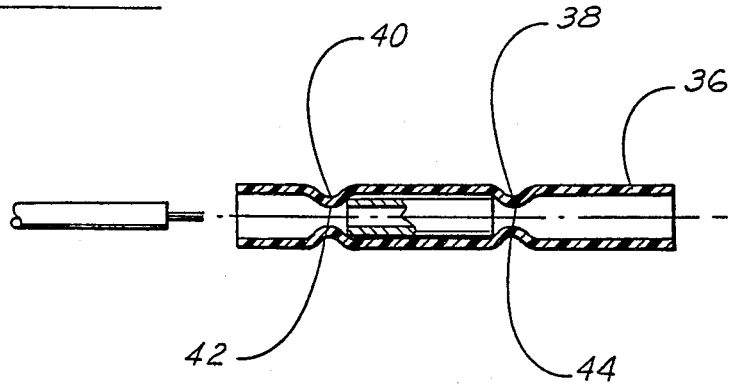
FIG. 4 is a cross-sectional view of another alternate embodiment of the crimp splicer.

Referring to FIG. 4, there is shown an alternative embodiment of the splicer having a sleeve shaped and sized to enable mechanical retention of the barrel therein. To mechanically retain the crimp barrel within the sleeve, the barrel is forced past a detent which is formed in the wall of the insulating sleeve. As the barrel passes the detent, it falls into a cavity whose inside diameter is larger than the diameter of the barrel. A detent of this type can be easily fabricated and remains functional over a wide fabrication tolerance band. The sleeve 36 is generally cylindrically-shaped and is provided with two spaced-apart detents formed as circumferentially disposed channels 38 and 40 in the wall of the sleeve. The channels form corresponding rims 42 and 44 respectively which protrude into the interior of the sleeve 36. The rims 42 and 44 have diameters which are less than the outer diameter of the metal barrel. However, at least one of the rims has a diameter which is only slightly less than the outer diameter of the metal barrel thereby enabling removal of the barrel from the sleeve past that rim through elastic deformation of the plastic insulation material. The barrel may be readily removed for crimping by inserting a wire into the barrel and pushing the barrel past such an appropriately sized rim. After crimping the barrel onto the wires, it may be reinserted into the sleeve by holding the sleeve stationary and pulling on the wire. In an alternative embodiment, the rim may be formed in circumferentially disposed sections rather than as a continuous ring.

Figure 5:
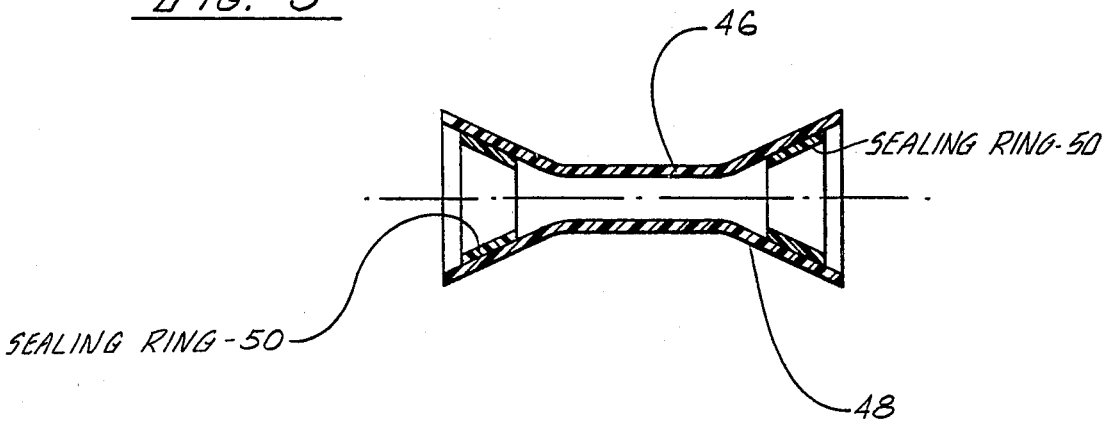
FIG. 5 is a cross-sectional view of an insulating sleeve having meltable inserts disposed therein.

Referring to FIG. 5, there is shown an insulating sleeve 46 adapted to frictionally retain a barrel therein and having its ends 48 flared outwardly to facilitate insertion of the barrel and wires into the sleeve. The sleeve is preferably comprised of a heat shrinkable material and is further provided with circumferentially disposed sealing rings 50. The rings 50 are comprised of material which will flow with the application of heat and environmentally seal the ends of the sleeve. Suitable materials for sealing rings are disclosed in the Wetmore U.S. Pat. No. 3,243,211, the disclosure of which is incorporated herein by reference.

In its preferred embodiment, the insulating sleeve consists essentially of a heat-shrinkable material but it will be obvious to one skilled in the art that other suitable insulating polymers may also be utilized. Suitable heat-shrinkable materials are disclosed in Cook U.S. Pat. No. 3,086,242, the disclosure of which is incorporated herein by reference. If the sleeve is comprised of a heat-shrinkable material, after forming the splice and reinserting the barrel back into the sleeve, the sleeve may be shrunk down around the barrel and wires to protect the splice from the environment.

The present invention may also be utilized for other electrical connections whose body must be all or partially covered with insulation after application such as pre-insulated ring terminals and spade terminals.

While an embodiment and application of this invention has been shown and described, it will be apparent to those skilled in the art that many more modifications are possible without departing from the inventive concepts herein described. The invention, therefore, is not to be restricted except as is necessary by the prior art and by the spirit of the appended claims.

What is claimed is:

1. A method for splicing electrical wires comprising the steps of:

(a) inserting a first electrical wire into a crimp barrel of a crimp splicer, the crimp splicer also including a deformable insulating sleeve having a bore, the crimp barrel consisting essentially of a ductile metal and being removably retained in the bore of the insulating sleeve;

(b) removing the crimp barrel from the insulating sleeve without damaging the insulating sleeve while maintaining both the crimp barrel and the insulating sleeve on the first wire;

(c) inserting a second electrical wire into the crimp barrel;

(d) crimping the removed crimp barrel for retaining the first and second wires therein; and (e) placing the crimped crimp barrel into the insulating sleeve without damaging the insulating sleeve.

2. The method of claim 1 in which the step of removing the crimp barrel from the sleeve comprises pushing on the first wire to urge the crimp barrel from the insulating sleeve.

3. The method of claim 1 in which the step of crimping the crimp barrel comprises crimping the crimp barrel before the second electrical wire is inserted into the crimp barrel and again crimping the crimp barrel after the second electrical wire is inserted into the crimp barrel.

4. The method of claim 1 in which the insulating sleeve has an oval shaped bore for at least a portion of its length, wherein the major diameter of the bore is larger than the diameter of the crimp barrel and the minor diameter of the bore is smaller than the diameter of the crimp barrel, and the step of removing the crimp barrel from the insulating sleeve comprises applying pressure along the major diameter of the insulating sleeve for deforming the insulating sleeve.

5. The method of claim 1 wherein the insulating sleeve comprises two axially spaced-apart first and second rims protruding into the bore, the first rim having a diameter only slightly less than the outer diameter of the crimp barrel and the second rim having a diameter less than the diameter of the first rim, the step of removing the crimp barrel from the insulating sleeve comprising deforming the first rim and removing the crimp barrel past the deformed first rim and the step of placing the crimped crimp barrel into the insulating sleeve comprising deforming the first rim and moving the crimped crimp barrel past the deformed first rim.

6. The method of claim 1, 4, or 5 wherein said sleeve consists essentially of a heat-shrinkable material, the method including the step of heating the sleeve for shrinking the sleeve over the crimped barrel after the step of placing the crimped barrel into the sleeve.

7. The method of claim 6 wherein said sleeve is further provided with fusible sealing rings disposed at each end thereof, the method including the step of heating the sleeve for fusing the sealing rings after the step of placing the crimped barrel into the sleeve.

8. The method of claim 1 wherein said sleeve has a bore with a diameter essentially equal to the outer diameter of said barrel.

9. The method of claim 8 wherein said sleeve is provided with a rim formed in the wall of said sleeve, said rim capable of preventing the removal of the barrel from one end of said sleeve, the step of placing the crimped barrel into the sleeve comprising inserting the barrel into the other end of the sleeve up to said rim.

10. The method of claim 9 wherein said other end of said sleeve is provided with a flare to facilitate the insertion of said barrel into said sleeve.

* * * * *